United States Patent [19]

Rose et al.

[11] 4,264,380

[45] Apr. 28, 1981

[54] NITRIDE CASEHARDENING PROCESS AND THE NITRIDED PRODUCT THEREOF

[75] Inventors: Thomas C. Rose; Roy W. Short, both of San Jose, Calif.

[73] Assignee: General Electric Company, San Jose, Calif.

[21] Appl. No.: 94,953

[22] Filed: Nov. 16, 1979

[51] Int. Cl.[3] ..... C21D 1/00

[52] U.S. Cl. ..... 148/16.6; 148/31.5

[58] Field of Search ..... 148/16.6, 31.5

[56] References Cited

U.S. PATENT DOCUMENTS

| | | | |
|---|---|---|---|
| 1,774,999 | 9/1930 | Sergeson | 148/16.6 |
| 1,804,176 | 5/1931 | McQuaid | 148/16.6 |
| 1,838,195 | 12/1931 | Sergeson | 148/16.6 |
| 1,958,575 | 5/1934 | Hengstenberg | 148/16 |
| 1,965,798 | 7/1934 | Egan | 148/16 |
| 2,025,134 | 12/1935 | Stammberger | 148/16.6 |
| 2,188,137 | 1/1940 | Malcom | 148/16.6 |
| 2,437,249 | 3/1948 | Floe | 148/16.6 |
| 2,596,981 | 5/1952 | Chenault et al. | 148/16.6 |
| 2,779,697 | 1/1957 | Chenault et al. | 148/16.6 |
| 2,789,930 | 4/1957 | Engelhard | 148/16.6 |
| 3,144,362 | 8/1964 | Bradd | 148/16.6 X |

OTHER PUBLICATIONS

Engineering Materials Handbook, McGraw-Hill Book Co., N.Y., 1958, pp. 21-22 to 21-24.

*Primary Examiner*—G. Ozaki

*Attorney, Agent, or Firm*—Ivor J. James, Jr.; Raymond G. Simkins; Samuel E. Turner

[57] ABSTRACT

A method of nitriding ferrous alloys for improving the quality and integrity of the resultant case or hardened surface portion formed thereby, comprising the application of a specific combination of sequenced temperature and nitrogen conditions.

18 Claims, 1 Drawing Figure

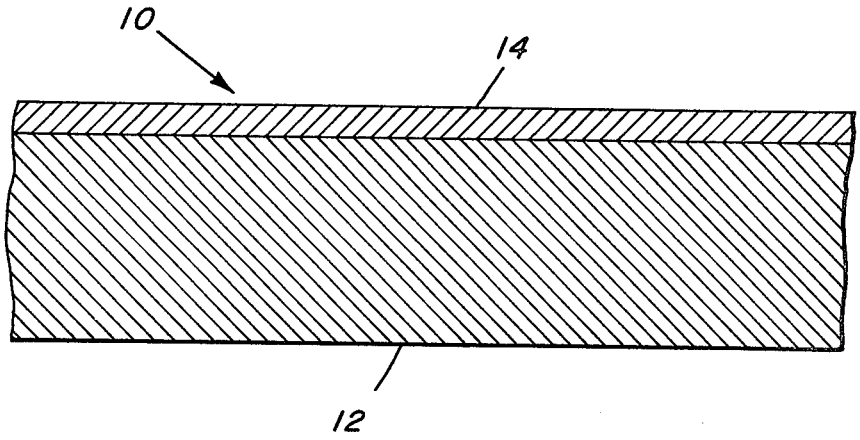
10
14
12

NITRIDE CASEHARDENING PROCESS AND THE NITRIDED PRODUCT THEREOF

This invention relates to a process of surface-hardening or casehardening ferrous alloys by heating such metals in the presence of ammonia as a source of nascent or active nitrogen, and in particular to a novel nitriding method for forming an improved, more uniform hardened and durable surface portion or case.

The hardening of steel surfaces or casehardening by heating steel in an atmosphere comprising gaseous ammonia as a source of nitrogen is an old and well known technique as is evidenced by U.S. Pat. No. 1,804,176 of May 5, 1931. As described in the *Engineering Materials Handbook*, McGraw-Hill Book Co. Inc., 1958, in page 21–22, gas nitriding typically comprises a first stage of holding the article to be casehardened at a temperature of 975° F. (524° C.) in an atmosphere of 20% dissociated ammonia, followed by a second stage of heating to and holding the article at a temperature of between 1025° F. (552° C.) and 1050° F. (566° C.) in an atmosphere of 85% dissociated ammonia.

However, there are a number of common specialty steels, including for example certain categories of ferrous steels relatively high in chrome, or chrome and nickel, and in particular austenitic stainless steels, which are particularly difficult or troublesome to nitride effectively. For instance, U.S. Pat. No. 2,789,930, issued Apr. 23, 1957, addresses this problem of the resistance of stainless steels of high chrome content ferrous alloys to nitriding and therefore proposes the introduction of hydrochloric acid into the process. The acid fumes according to this patent combine with the ammonia gas, forming ammonium chloride for the purpose of altering the oxide film of the chrome that constitutes a barrier to nitrogen.

Moreover, in addition to such difficulties with respect to nitride casehardening of common types of stainless steel, when applied to certain classes of ferrous alloys the prior art procedures or techniques for gas nitriding often fail to produce a continuous and uniform, flaw-free nitride case or hardened portion extending evenly over the entire surface portion so treated.

It is a primary object of this invention to provide a new method of nitriding ferrous alloys that produces improved casehardened articles and products.

It is also an object of this invention to provide a method of nitriding ferrous alloys that is exceptionally effective and efficient when applied to high chrome and/or high nickel-containing ferrous alloys including austenitic stainless steels and the like.

It is a further object of this invention to provide a new method of nitriding ferrous alloys including those containing high proportions of chrome and nickel that produces a continuous casehardened, nitrided surface phase over the alloy of uniform and sound consistency and free of flaws or breaks.

It is a still further object of this invention to provide a method of casehardening ferrous alloys including those containing high proportions of chrome and nickel that forms a uniform nitride case or extremely hard surface portion that is highly resistant to wear and corrosion, exhibits minimum warpage or distortion, and has very low tendency to seize or gall, among other advantages.

The drawing comprises a schematic, enlarged sectional view of an article of a ferrous alloy having a nitride casehardened surface portion or phase thereon.

In accordance with this invention, uniformly continuous and flaw-free improved casehardened surfaces can be produced on ferrous alloys that are generally difficult to nitride by means of a specific combination of sequenced temperature and nitrogen conditions as set forth hereinafter.

Briefly, the method of this invention comprises a nitriding process wherein the ferrous alloy article to be casehardened is subjected to a combination and sequence of heating and gaseous nitrogen additions, comprising: (1) a preceding stage of a temperature below about 496° C. (925° F.) and atmosphere of low ammonia dissociation; (2) an intermediate or transition stage of an atmosphere of relatively high ammonia dissociation; followed by (3) a subsequent stage of an increased temperature of at least 535° C. (1000° F.) and atmosphere of reduced and intermediate level of ammonia dissociation with respect to the other stages.

Specifically, according to a preferred embodiment, the preliminary temperature stage for the practice of this invention, comprises, after routinely heating and purging the atmosphere about the article of a ferrous alloy with an apt nitrogen containing gas such as anhydrous ammonia, holding the article at a temperature within a range of about 480° C. (900° F.) up to about 496° C. (925° F.) for a relatively brief period of generally about one-half to one or two hours. During such preliminary heat treating stage the atmosphere about the article undergoing nitriding comprises anhydrous ammonia and a relatively low ammonia dissociation ratio of about 8 to about 15%.

Next, in the intermediate or transition stage, the atmosphere about the article of substantially anhydrous ammonia is diluted and partially flushed away by the addition of dissociated ammonia until the resulting atmosphere contains greater than about 80% dissociated ammonia.

Thereafter, in the subsequent temperature stage of the nitriding method, the article is heated up to and held at a temperature within the range of about 570° C. (1060° F.) to about 585° C. (1080° F.), and upon reaching this temperature condition the ammonia dissociation level is reduced to a range of about 65 to about 75% dissociation, and there held, by regulating the proportions of anhydrous ammonia and dissociated ammonia supplied to the atmosphere. The conditions of this latter stage are then substantially maintained throughout the balance of the nitriding process and until a nitride case or hardened surface portion of the ferrous alloy of sufficient depth or dimension is formed. On attainment of an adequate case or nitride hardening depth, the application of heat is terminated and the article permitted to cool to ambient.

Although the above described nitriding process of this invention is applicable and effective when applied to ferrous alloys or steel generally, this process is especially advantageous and useful for gas nitriding the more difficult to nitride high chrome containing ferrous alloys such as stainless steels and in particularly the austenitic stainless steels including the 300 series of such steels. Ferrous alloys or steel of such compositions and general resistance to nitriding can be treated by means of the nitriding process of this invention which effectively and efficiently produces thereon a highly uniform and essentially flaw-free continuous case or hardened nitrided surface portion or layer that is durable and resistant to wear and corrosion, galling or seizure, and warpage or distortion. The atmospheric conditions such as ammonia content and dissociation ratios thereof as a source of nascent or active nitrogen can be readily provided and controlled by means of conventional techniques. For instance they can comprise providing a source or supply of both anhydrous ammonia and dissociated ammonia and regulating the proportions thereof introduced into the atmosphere of the system so as to provide the specified conditions of ammonia and percentage of dissociation called for by the method of the invention.

This method, moreover, can be carried out in a conventional retort furnace or other apt heat treating means wherein the atmosphere can be isolated and controlled. Also conventional measures can be used to mask or block off surface portions of an article which are not required or desired to be case or nitride hardened. For example, portions can be masked and protected from nitriding by cover plating with tin, bronze or copper, and certain specialty paints.

The following comprises a specific example of a preferred mode for the practice of this invention for producing a uniformly consistent and flaw-free continuous case or hardened surface on a difficult to nitride stainless steel alloy identified by the trade designation "Stainless Steel X M-19". This grade of stainless steel has the following high chrome and nickel alloy composition in percent by weight:

Chromium—20.5–23.5
Nickel—11.5–13.5
Manganese—4.0–6.0
Molybdenum—1.5–3.0
Silicon—1.00 max.
Nitrogen—0.25–0.35
Columbium—0.15–0.30
Vanadium—0.15–0.30
Copper—0.15 max.
Cobalt—0.05 max.
Carbon—0.04 max.
Phosphorus—0.020 max.
Oxygen—0.015 max.
Sulfur—0.010 max.
Total Trace Elements—0.40 max.
Iron—Balance Articles comprised of the above stainless steel alloy and having surface portions to be nitride casehardened were suitably cleaned with a solvent and positioned in a conventional retort furnace having means for sealing and controlling the atmosphere therein comprising fluid intake means and an exhausting vent. The furnace was connected with a source of anhydrous ammonia and a source of dissociated ammonia, and apt flow-control and proportioning means associated therewith.

On sealing the articles within the furnace, the temperature therein was raised to about 488° to 496° C. (910°–925° F.) and the furnace atmosphere purged with anhydrous ammonia. After reaching the preceding temperature stage of 488° to 496° C., the ammonia gas supplied to the furnace was adjusted to provide a dissociation of 8 to 15% within the furnace atmosphere and this temperature level and dissociation ratio was maintained therein for about one hour.

Thereupon, the flow of the anhydrous ammonia to the furnace was reduced and the flow of dissociated ammonia increased to adjust the ammonia dissociation ratio of the furnace atmosphere to 85 to 95% for the intermediate or transition stage.

Upon attaining a furnace atmosphere of 85 to 95% dissociated ammonia, the temperature was then increased therein to 577°–582° C. (1070°–1080° F.) and upon attaining said temperature the ammonia gas supply was again adjusted to reduce the atmosphere ammonia dissociation to 65 to 75% for the subsequent temperature stage. These latter temperature and ammonia dissociations conditions were maintained for a 40-hour run of the subsequent temperature stage which comprised the period of time required to achieve a uniform nitride case depth to about 0.004 to 0.007 inches. At completion of the run the furnace was shut down and the ammonia atmosphere maintained until the temperature dropped below about 150° C. (300° F.).

The nitride case or hardened surface portions were found upon examination to be uniform in depth and consistency, and free of flaws or breaks.

Referring to the drawing, there is shown an enlarged sectional view of an article produced by the method of this invention. The article 10 comprises a body or substrate 12 of a high chrome content stainless steel alloy having a nitride case or hardened surface portion 14 formed and superimposed thereover.

We claim:

1. A method of nitriding ferrous alloys to harden a surface portion thereof, comprising the combination and sequence of distinct steps of:

(a) first heating a ferrous alloy article to a high temperature of below about 496° C., and subjecting said article to an atmosphere comprising anhydrous ammonia;

(b) then displacing at least a portion of the anhydrous ammonia of the atmosphere about the article by the addition of dissociated ammonia;

(c) thereafter heating the article to a temperature of at least about 535° C.; and (d) then reducing the level of dissociated ammonia in the atmosphere about the article.

2. The method of claim 1, wherein the article is initially heated to a temperature of about 480° to about 496° C.

3. The method of claim 1, wherein the anhydrous ammonia of the atmosphere about the article is displaced by the addition of dissociated ammonia in amount providing an ammonia dissociation in the atmosphere greater than about 80%.

4. The method of claim 1, wherein the article is subsequently heated to a temperature of about 570° to about 585° C.

5. The method of claim 1, wherein the ammonia dissociation in the atmosphere about the article of greater than 80% is reduced to about 65 to about 75% after the temperature is increased to about 570° to about 585° C.

6. A method of nitriding ferrous alloys to harden a surface portion thereof, comprising the combination and sequence of distinct steps of:

(a) heating a ferrous alloy article to a preceding high temperature stage of below about 496° C., and subjecting said heated article to an atmosphere comprising anhydrous ammonia;

(b) then providing an ammonia atmosphere about the article of greater than about 80% ammonia dissociation by the addition of dissociated ammonia;

(c) thereafter heating the article to a subsequent temperature stage of higher than about 535° C.; and (d) then providing an ammonia atmosphere about the article of about 65 to 75% ammonia dissociation.

7. The method of claim 6, wherein the ferrous alloy comprises a chrome containing stainless steel.

8. The method of claim 6, wherein the article is heated to a temperature of about 480° to about 496° C. in the preceding temperature stage.

9. The method of claim 6, wherein the anhydrous ammonia of the atmosphere about the article is displaced in part by the addition of dissociated ammonia.

10. The method of claim 6, wherein the article is heated to a temperature of about 570° to about 585° C. in the subsequent temperature stage.

11. A method of nitriding chrome-containing ferrous alloys to harden a surface portion thereof, comprising the combination and sequence of distinct steps of:

(a) heating a chrome-containing ferrous alloy article to a preceding temperature stage of about 480° to about 496° C., and subjecting said heated article to an atmosphere comprising anhydrous ammonia;

(b) then displacing at least a portion of the anhydrous ammonia of the atmosphere about the article by the addition of dissociated ammonia in amount providing an ammonia dissociation greater than about 80% in the atmosphere about the article.

(c) thereafter heating the article to a subsequent temperature stage of about 570° to about 858° C.; and (d) then reducing the ammonia dissociation of the atmosphere about the article to about 65 to about 75%.

12. The method of claim 11, wherein the chrome-containing ferrous alloy comprises stainless steel.

13. The method of claim 11, wherein the article is held at the preceding temperature stage of about 480° to about 496° C. over a period of at least about one half hour.

14. The method of claim 11, wherein the degree of dissociation of the ammonia in the atmosphere about the article is provided by supplying thereto anhydrous ammonia and dissociated ammonia and proportioning the amounts supplied thereto.

15. The method of claim 11, wherein the article is held at the preceding temperature stage of about 480° to about 496° C. over a period of about one half hour to about two hours.

16. A method of nitriding chrome-containing ferrous alloys to harden a surface portion thereof, comprising the combination and sequence of distinct steps of:

(a) heating a chrome-containing ferrous alloy article to a preceding temperature stage of about 480° to about 496° C., and holding the article at said temperature over a period of at least about one-half hour while subjecting said heated article to an atmosphere comprising anhydrous ammonia;

(b) then displacing at least a portion of the anhydrous ammonia of the atmosphere about the article by the addition of dissociated ammonia in amount providing an ammonia dissociation greater than about 80% in the atmosphere about the article;

(c) thereafter heating the article to a subsequent temperature stage of about 570° to about 585° C.; and (d) then reducing the ammonia dissociation of the atmosphere about the article to about 65 to about 75% by proportioning amounts of anhydrous ammonia and dissociated ammonia provided to the atmosphere about the article.

17. The method of claim 16, wherein the article is held at the preceding temperature stage of about 480° to about 496° C. over a period of about one half hour to about two hours.

18. The method of claim 16, wherein the ammonia dissociation during the preceding temperature stage is provided at about 8 to about 15%.

* * * * *